United States Patent [19]

Graser

[11] 4,398,631

[45] Aug. 16, 1983

[54] RETURNABLE WRAP-AROUND BEVERAGE CARRIER

[75] Inventor: Earl J. Graser, Monroe, La.

[73] Assignee: Manville Service Corporation, Denver, Colo.

[21] Appl. No.: 219,187

[22] Filed: Dec. 22, 1980

[51] Int. Cl.[3] ..... B65D 75/04

[52] U.S. Cl. ..... 206/427; 206/141; 206/162; 206/167; 206/196; 206/434; 229/52 B

[58] Field of Search ..... 206/140–163, 206/183, 193, 427, 434, 167, 196; 229/40, 27, 52 B

[56] References Cited

U.S. PATENT DOCUMENTS

| | | | |
|---|---|---|---|
| Re. 29,063 | 12/1976 | Graser | 206/141 |
| 2,525,686 | 10/1950 | Kowal . | |
| 2,741,399 | 4/1956 | Arneson | 229/27 X |
| 2,850,205 | 9/1958 | Painter . | |
| 3,186,545 | 6/1965 | Conrades | 206/155 |
| 3,191,800 | 6/1965 | Kowal . | |
| 3,356,283 | 12/1967 | Champlin | 206/158 |
| 3,411,663 | 11/1968 | Moore et al. . | |
| 3,974,911 | 8/1976 | Graser | 206/141 |
| 4,103,770 | 8/1978 | Brandenburger et al. | 206/193 |
| 4,131,230 | 12/1978 | Koehlinger et al. | 206/158 |
| 4,155,449 | 5/1979 | Bryne | 206/427 |
| 4,184,626 | 1/1980 | Graser et al. | 229/40 |
| 4,185,744 | 1/1980 | Peterson | 206/427 |
| 4,186,867 | 2/1980 | Wood | 229/40 |
| 4,234,081 | 11/1980 | Champlin | 206/147 |
| 4,256,226 | 3/1981 | Stone | 206/427 |
| 4,278,168 | 7/1981 | Wood | 206/427 |
| 4,295,562 | 10/1981 | Wood | 206/158 |
| 4,314,634 | 2/1982 | Stone | 206/167 |
| 4,328,891 | 5/1982 | Elward | 206/427 X |

*Primary Examiner*—William Price
*Assistant Examiner*—Gary E. Elkins
*Attorney, Agent, or Firm*—R. M. Halvorsen; J. D. Lister

[57] ABSTRACT

A returnable wrap-around beverage carrier and production blank for forming a carrier. The beverage carrier and production blank are formed in a one-piece construction and contain an inner double-walled longitudinal partition in the preferred embodiment which is formed from a partial side panel and is fixedly attached to the bottom wall of the carrier through a plurality of glue tabs. The two longitudinal partition panels of the preferred embodiment contain handle means for carrying the erected carrier after the top panel has been torn off and the bottles have been removed by the customer.

3 Claims, 8 Drawing Figures

28
26
30
14
16
12
36
160
44
32
46
160
160
160
38
48
56
52
60
58
62
102
100
80
82
72
108
112
128
110
114

RETURNABLE WRAP-AROUND BEVERAGE CARRIER

BACKGROUND OF THE INVENTION

This invention relates to beverage carriers in general and in particular to a novel one-piece returnable wrap-around beverage carrier having an internal handle formed in a longitudinal partition panel and novel bottle separator tabs formed in the bottom panel.

It is known in the prior art of designing beverage carriers to provide a basket-style carrier having a central longitudinal panel of single or double thicknesses. It is also known in the art to fasten longitudinal partition panels to the bottom structure of the carrier proper in order to firmly fix the longitudinal handle panel to the carrier thereby allowing the weight of the bottles in the carrier to be carried through the handle structure. Such a construction is shown in the U.S. Pat. No. 2,525,686, issued to M. H. Kowal on Oct. 10, 1950.

It is known in the prior art of wrap-around beverage carriers to provide bottle separation tabs hinged from the bottom panel of the carrier as shown in the U.S. Pat. No. 4,186,867, issued to Prentice J. Wood on Feb. 5, 1980. The tabs taught by the Wood patent are generally L-shaped and have a lower edge (P) designed to be disposed below the lowermost part of the bottle label.

It is desirous in the construction of a wrap-around beverage carrier of the type encompassing the applicant's invention to provide a one-piece returnable wrap-around carrier which does not require separate partitions, either longitudinal or transverse, in the carrier. The use of separate partitions requires additional machinery in the erecting stage of the carrier in order to insert and glue the partition or partitions to the interior of the structure. It is also desirous of provising other means of bottle separation through the use of a novel design of bottom separator tabs.

SUMMARY OF THE INVENTION

In order to overcome the problems inherent in the prior art carriers, there has been provided by the subject invention a new and novel one-piece returnable wrap-around beverage carrier which has a longitudinal center handle panel formed from the one-piece carrier structure. In addition, the longitudinal handle structure is physically adhered to the bottom panel of the carrier through a plurality of glue tabs formed in the bottom panel.

A plurality of novel separator means in the form of separator tabs are also formed in the bottom panel of the carrier and these tabs function in combination with bottle neck receiving openings formed in the top panel to separate the adjacent bottles from each other within the carrier. The novel separator tabs are designed to prevent bottle label disfigurement upon insertion of the bottles into the carrier by the bottler. A handle opening is formed in the longitudinal partition panel and a handle opening is formed in the top panel. When the completed carrier is fully erected, the top panel handle opening is used to carry the erected carrier with its bottle contents. The top panel may then be removed by the use of removing means in the form of tear out openings to thereby expose the bottles in the carrier. The handle opening formed in the longitudinal partition panel would then be used to carry the carrier with the empty bottles after the customer has consumed the contents.

Accordingly, it is an object and advantage of the invention to provide a one-piece returnable wrap-around beverage carrier having at least one longitudinal partition panel formed from the carrier structure integral with that structure with the partition panel being fixedly attached to the bottom panel of the carrier.

Another object and advantage of the invention, is to provide a one-piece returnable beverage carriier which has all of the internal partitions formed integrally with the carrier thereby requiring no external partitions to be glued in the carrier.

A further object and advantage of the invention is to provide a one-piece returnable beverage carrier having improved bottle separation tabs formed on the bottom panel to prevent bottle label disfigurement upon insertion of bottles in the carrier by the bottler.

These and other objects and advantages of the invention will become apparent from a review of the drawings and from a reading of the description of the preferred embodiment.

DESCRIPTION OF THE PREFERRED EMBODIMENT

Figures 1, 2:
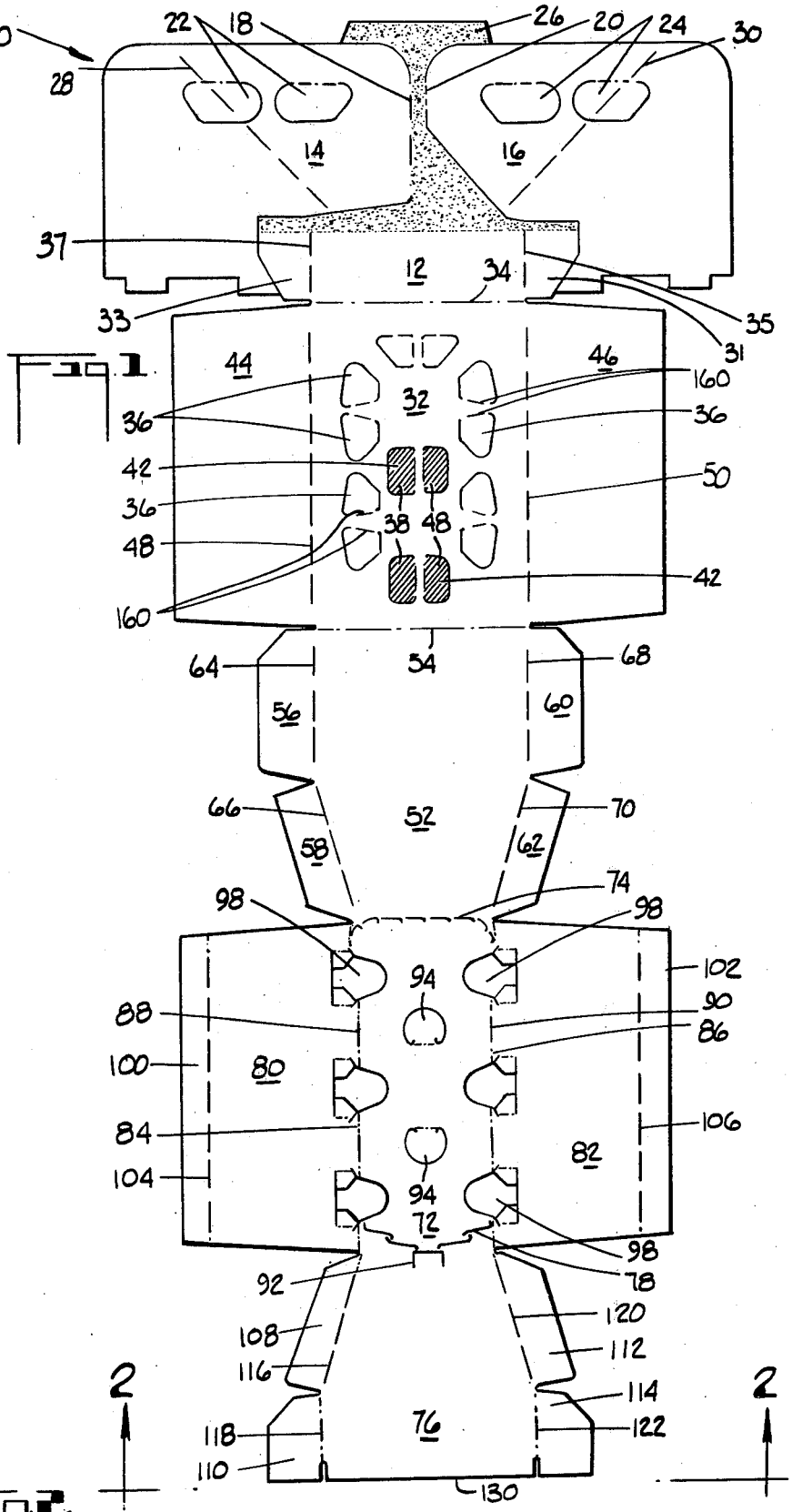
FIG. 1 is a top plan view of the production blank of the preferred embodiment for the subject carrier showing the respective panels in their flat position prior to being folded. The top plan view of FIG. 1 would represent the coated side of the paperboard production blank with the underside of the paperboard generally being left uncoated in the preferred embodiment.
FIG. 2 is an end view taken along line 2—2 of the production blank shown in FIG. 1.
Figure 3:
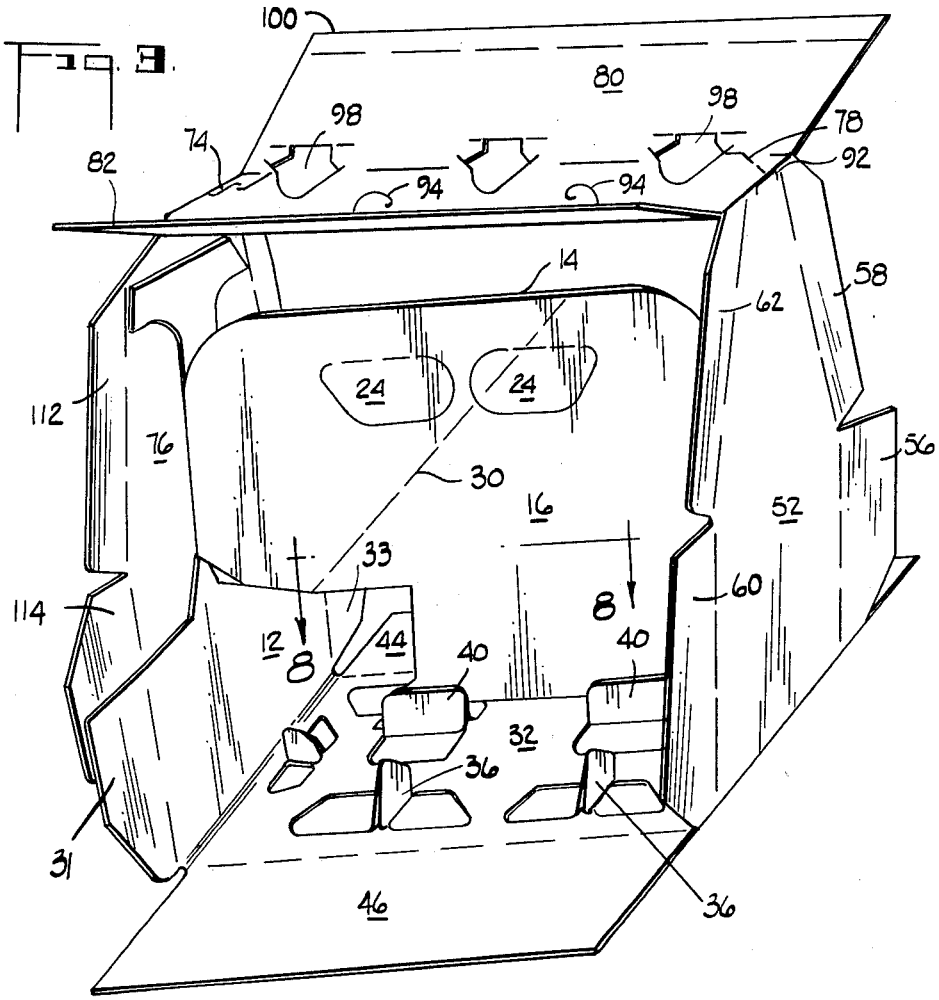
FIG. 3 is a perspective view of the production blank shown in FIG. 1 showing it completely folded and erected with the partial side panels being glued together and also showing the pair of longitudinal partition panels fixedly attached to the bottom panel by means of the plurality of glue tabs.

Referring now in general to the drawings and in particular to FIG. 1 of the drawing, there is shown the preferred embodiment of the one-piece returnable beverage carrier production blank generally by the numeral 10 which comprises a first partial side panel 12 which has hingedly attached thereto a plurality of longitudinal partition panels 14 and 16 by means of the scorelines 18 and 20. The longitudinal partition panels 14 and 16 have formed therein a plurality of handle openings 22 and 24 and may be constructed with at least one handle opening instead of the two handle openings shown in each partition. The first partial side panel 12 also has applied thereto a quantity of adhesive 26 shown generally by the stipling in the drawing FIG. 1. The adhesive 26 would be applied after the production blank 10 has been printed and die cut and would be applied in the folding and erecting machine used to set up the production blank into an erected carrier as shown in FIG. 3 of the drawing.

A diagonal cut score line 28 and 30 is formed on each of the longitudinal partition panels 14 and 16 for the purposes which will be described hereinafter. A glue flap 31 and 33 is formed on the first partial side panel by means of the scorelines 35 and 37.

Figure 6:
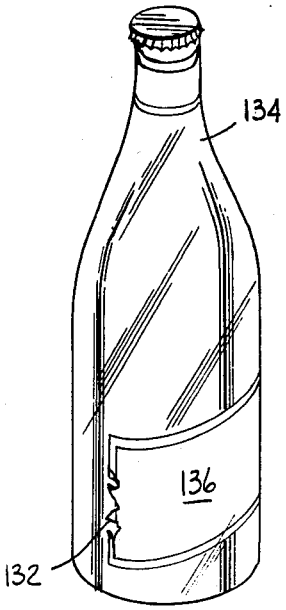
FIG. 6. (PRIOR ART)
FIG. 6 is a perspective view of a bottle showing label disfigurement caused by prior art type of bottom separator tabs.
Figure 7:
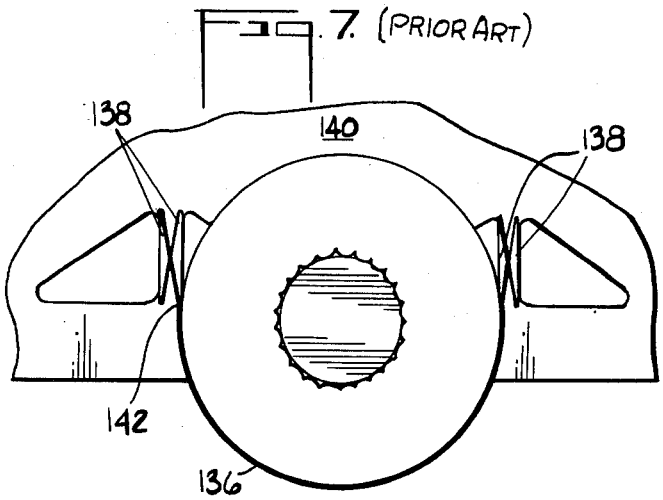
FIG. 7. (PRIOR ART)
FIG. 7 is an enlarged top view of a typical prior art bottom structure of a returnable beverage carrier showing how prior art type of label separation tabs cause label disfigurement upon insertion of bottles by the bottler.
Figure 8:
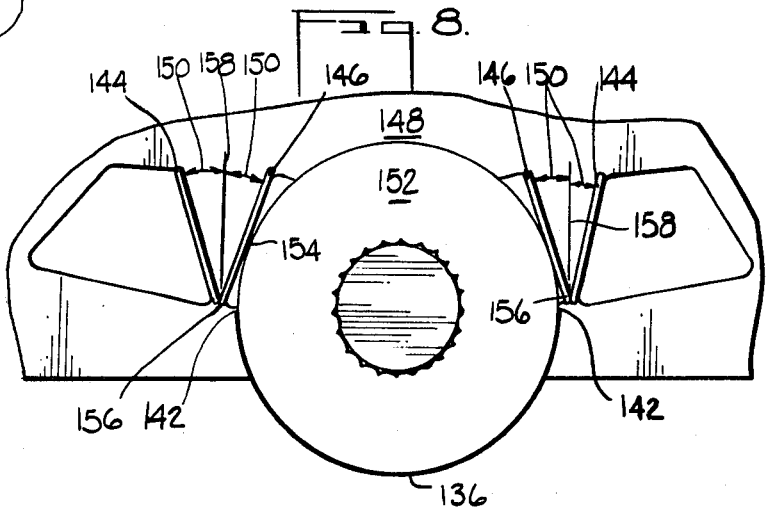
FIG. 8 is an enlarged top view of the applicant's bottom structure taken along line 8—8 of FIG. 3 showing the applicant's improved bottle separation tabs and how they function to eliminate bottle label disfigurement.

A central bottom panel 32 is hingedly attached to the first partial side panel 12 by means of the score line 34 and has formed therein the novel separator means in the form of tabs 36 whose function will also be described here and after when referring to FIGS. 6–8. The bottom panel 32 also has formed therein the plurality of glue tabs 38 and 40 which are utilized to glue the longitudinal partition panels remove 14 and 16 to the bottom panel 32. For example, the glue tabs 38 are utilized to glue the longitudinal partition panel 14 to the bottom panel 32 while the glue tabs 40 are utilized to glue the longitudinal partition panel 16 to the bottom panel 32. The glue tabs 38 and 40 have a quantity of adhesive 42 applied to the opposite side of the production blank from that shown in FIG. 1 of the drawing. The adhesive 42 is shown in FIG. 1 by the diagonal lines on the glue tabs 38 and 40 and would represent adhesive applied to the under side of the blank on the uncoated side. This adhesive 42 would also be applied after the production blank has been printed and die cut and during its erection in the folding and erecting machine utilized to form the beverage carrier.

The bottom panel 32 also has hingedly attached thereto a pair of lower side panels 44 and 46 by means of the score lines 48 and 50. In addition the bottom panel 32 also has hingedly attached thereto a whole end panel 52 by means of the score line 54 as shown in the drawing. The whole end panel 52 has formed thereon a plurality of glue flaps 56, 58, 60 and 62 by means of the score lines 64, 66, 68 and 70.

A top panel 72 is hingedly attached to the whole end panel 52 by removing means in 74 in the form of a tear-out perforation and is also hingedly attached to a second partial end panel 76 by a removing means 78 in the form of another tear-out perforation.

The top panel 72 also has hingedly attached thereto on each side thereof, an upper side panel 80 and 82 which is hingedly attached to the top panel 72 by means of the score lines 84 and 86 combined with the die cut 88 and 90 as shown in the drawing. The tear out perforations 74 and 78 in combination with the score lines 84 and 86 and the die cuts 88 and 90 are utilized by the customer to tear out a major portion of the top panel 72 by inserting the finger in the tab opening 92 and removing the major portion of the top panel.

The top panel 72 also contains at least one handle opening and in the preferred embodiment shown in FIG. 1 two handle openings are provided in the form of two hinged tabs 94 which is pushed down into the central portion of the carton as is known in the prior art. The top panel 72 and portions of the upper side panels also contain a plurality of bottle openings 98 through which the necks of the beverage bottles are positioned whenever the production blank is erected into a completed carrier.

The upper side panels 80 and 82 also have formed thereon a glue tab 100 and 102 by means of the score line 104 and 106. The glue tab will be described more fully hereinafter in referring especially to FIGS. 3 and 4 of the drawing showing the erection of the carton and the final gluing thereof. The second partial end panel 76 also has formed thereon glue tabs 108, 110, 112 and 114 by means of the cut score lines 116, 118, 120 and 122.

Referring now to FIG. 2 of the drawings that are shown an end view taken along line 2—2 of FIG. 1 showing the type of production blank normally utilized in the formation of the beverage carrier of FIG. 1. The production blank may be formed of paperboard of conventional thickness but may also be formed of other materials within the spirit and scope of the invention. The top side of the production blank 124 would generally be coated with a clay coating having printable qualities while the underside 126 of the production blank generally would remain uncoated and would be exposed brown craft paperboard in the preferred embodiment.

Referring now to FIG. 3 of the drawing there is shown a perspective view of the production blank of FIG. 1 showing the completed erected carrier and showing the first partial side panel 12 glued to the second partial end panel 76 and also showing the two longitudinal partition panels 14 and 16 glued to their respective glue tabs 38 and 40 which have been turned vertically from the bottom panel 32. It can be seen by studying FIG. 3 that the diagonal score lines 28 and 30 formed on the longitudinal partition panels 14 and 16 then allow each longitudinal partition panel to be folded outwardly and collapsed against itself so that the erected carton may be folded flat for shipment to the bottler. The beverage bottles would then be inserted in the package after it has been open to the position shown in FIG. 3. The novel partition tabs 36 are used to separate the bottoms of the bottles placed within the carrier and the bottle openings 98 are used to hold and separate the necks of the bottles to be inserted into the carrier by the packaging machine. The particulars of construction of tabs 36 will be detailed hereinafter when referring to FIGS. 6–8 of the drawings.

Figure 4:
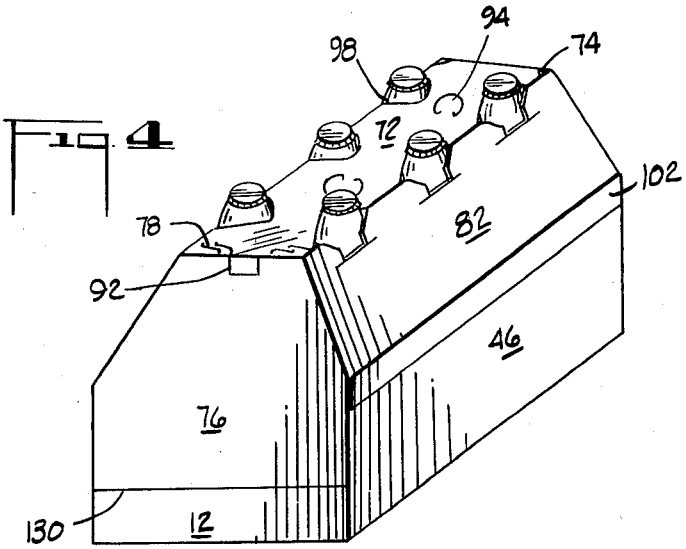
FIG. 4 is a perspective view of the erected package shown in FIG. 3 showing the lower side panels folded up and the upper side panels folded down and overlapped and glued to the lower side panels. The view in FIG. 4 would be of the package as it was completely erected and having a plurality of beverage bottles contained within.

By referring to FIG. 4 of the drawing there can be seen the completed package which would have a plurality of bottles contained therein and would have the lower side panels 44 and 46 turned upwardly and would then have the upper side panels 80 and 82 turned downwardly to overlap the lower side panels with the glue tabs 100 and 102. The glue tabs 100 and 102 would have a predetermined quantity of adhesive applied thereto during the packaging operation which would then allow the glue tabs to adhere to the lower side panels.

When the ultimate purchaser of the package desires to remove the contents thereof, he simply tears off a major portion of the top panel 72 by impressing his finger in the tab 92 tearing the top panel 72 along the removing means 74 and 78 and along the score lines 84, 86 and the die cuts 88 and 90. Thereafter the bottles may be removed and the empty bottles may be replaced in the carton utilizing the longitudinal partition panels 14 and 16 with their handle openings 22 and 24 as the means to carry the package with its empty bottles back to the retail outlet.

It can be seen in FIG. 3 of the drawing how the longitudinal partition panels 14 and 16 are anchored to one end of the carrier by means of the first partial end panel 12 and a second partial end panel 76 and are anchored to the bottom 32 of the carrier by means of the glue tabs 38 and 40. In the preferred embodiment, it is noted that the longitudinal partition panels 14 and 16 are not adhered to the whole end panel 52 since it is necessary to collapse the longitudinal partition panels 14 and 16 as before mentioned by the use of the 45° angled score lines 28 and 30 in order that the erected carrier may be folded flat for shipment to the bottler. The anchoring of the longitudinal partition panels 14 and 16 at the bottom and at one end panel only allows the package with the built in handles to open automatically with much more efficiency than previous designs having internal partitions built in since no reverse folds are encountered and binding between the end panels is eliminated by this particular design.

Figure 5:
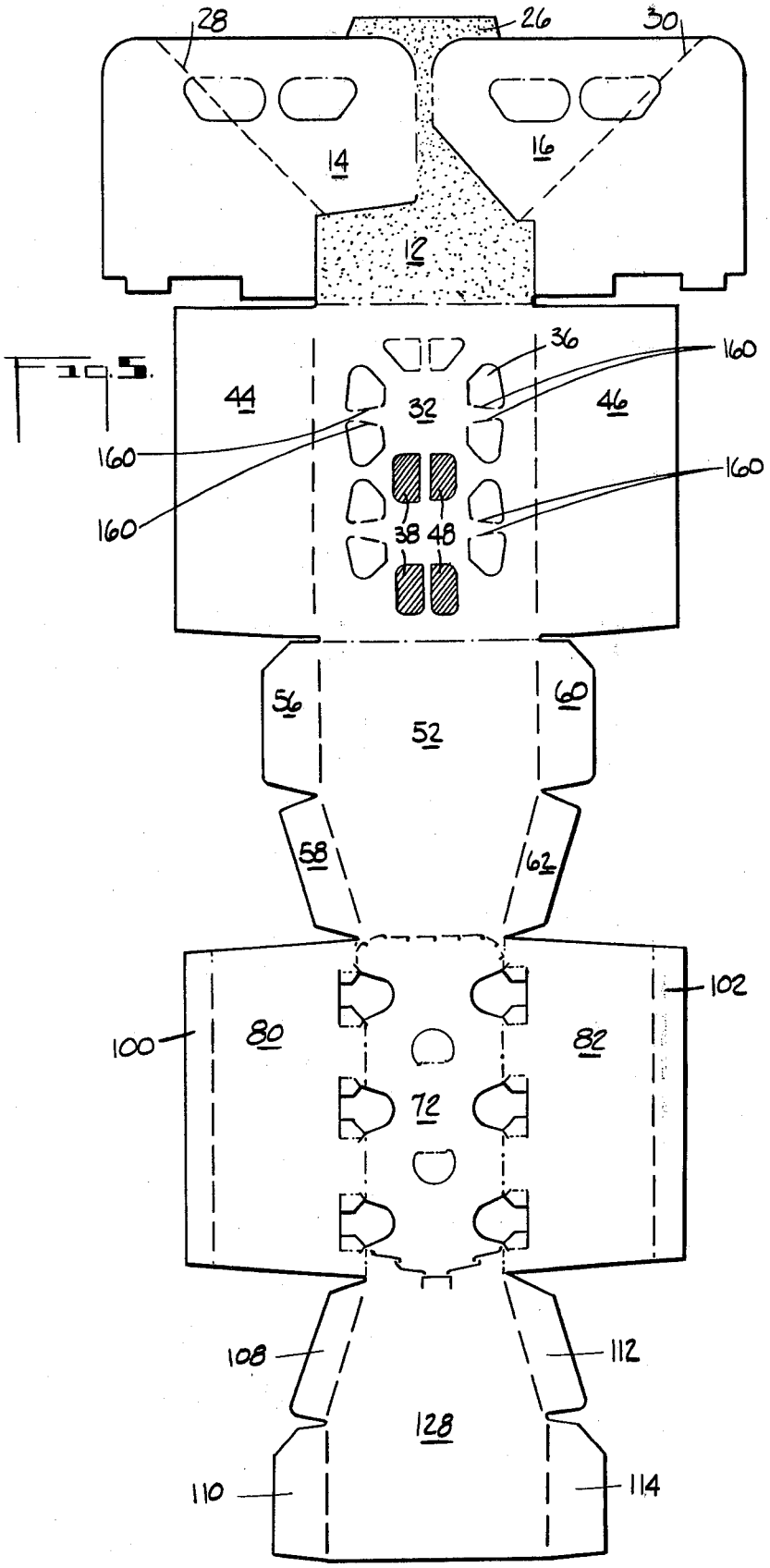
FIG. 5 is a top plan view of the production blank of a modification of the preferred embodiment shown in FIG. 1.

Referring now to FIG. 5 of the drawing there is shown a top plan view of the production blank of a modification of the preferred embodiment shown in FIG. 1. It can be seen that by referring to FIG. 1 and FIG. 5 together that the production blanks are essentially similar with the differences which will now be described. The production blank in FIG. 5 is formed with a full end panel 128 instead of a second partial end panel 76 as shon in FIG. 2. The full end panel 128 is adhesively secured when the production blank is folded to the first partial end panel 12 which has adhesive 26 applied throughout the entire length of the panel. In addition, the first partial end panels 12 does not have formed thereon the panels 31 and 33 which are hingedly attached to the first partial end panel 12 by the score lines 35 and 37 as shown in FIG. 2 of the drawing. Since the end panel 128 is full in the modification shown in FIG. 5, it is not necessary to have the panels 31 and 33 utilized in the version shown in FIG. 1.

The remaining portions of the production blank modification shown in FIG. 5 are similar to that shown in FIG. 2 with the use of the longitudinal partition panels 14 and 16 having the diagonal cut score line 28 and 30 formed therein. The bottom panel 32 is similar in the FIG. 5 version having attached thereto the lower side panels 44 and 46 and also having formed thereon the separator means or tabs 36 which will be described in more detail hereinafter. The glue tabs 38 and 40 are utilized as in the FIG. 1 version to adhesively secure the longitudinal partition panels 14 and 16 to the bottom panel 32. A whole end panel 52 is hingedly attached to the bottom panel 32 in a manner similar to the FIG. 1 version and a top panel 72 having attached upper side panels 80 and 82 is hingedly attached to the whole end panel 52.

A folded view of the production blank shown in FIG. 5 has not been drawn for purposes of brevity but it can be readily seen by one skilled in the art that whenever the production blank shown in FIG. 5 is folded it would look similar to the folded production blank of FIG. 3 with the exception that the second partial end panel 76 would be eliminated and substituted in place thereof would be the full end panel 128 which would be fixedly attached by adhesive to the first partial side panel 12 which would have the flaps 31 and 33 eliminated as has been before mentioned. The production blank modification of FIG. 5 would also be completely folded as shown in FIG. 4 of the drawing after having bottles inserted in the package and would look similar to FIG. 4 with the exception of the second partial end panel 76 which would be eliminated as has been before mentioned and replaced by the full end panel 126 which would totally overlap the first partial side panel 12. In the modification shown in FIG. 5 then the edge 130 would be eliminated which would then provide a full end panel 128 upon which could be placed advertising over the complete end panel without having a line 130 cutting through the advertising in the lower portion thereof.

Referring now to FIGS. 6 through 8 of the drawing there will be described how the applicant's novel bottom structure separator tabs function to eliminate bottle label disfigurement as has been before mentioned.

During the insertion of bottles into a returnable wraparound carrier of the type shown in FIG. 3 of the drawing, it is necessary to insert the bottles sideways into the carrier and the use of prior art bottle separation tabs often times will tear the bottle label as shown in FIG. 6 of the drawing. A bottle 134 would often times have the label 136 torn at the side edge as at the numeral 132 shown in FIG. 6 of the drawing.

By referring to FIG. 7 of the drawing there is shown an enlarged top view of a typical prior art bottom structure showing a plurality of bottle separator tabs 138 which have been hingedly turned out of the bottom 140 of the prior art structure. It can be seen in FIG. 7 how the label 136 which has been shown by a heavy line in FIG. 7 will be disfigured by the edge 142 when the separator tab 138 catches on the label edge. When this occurs, then the disfigurement shown in FIG. 6 of the drawing occurs and makes the bottle less appealing to the user of the beverage. When the bottle 134 has an angularly displaced label as shown in FIG. 6 of the drawing then only the left edge of the label would be disfigured whereas if the bottle 134 had a horizontally positioned label then it is possible that both the left and right edge of the label could be disfigured as the bottle 134 is inserted between the adjacent separator tabs 138.

Referring now to FIG. 8 of the drawing there is shown the applicant's novel improvement which comprises the utilization of a plurality of adjacent tabs 144 and 146 which are hingedly turned out of the bottom 148 and are placed at a predetermined angle 150 which permits the bottles to be inserted into the carrier with the bottle 152 striking the flat plane of the tab 146 at the area 154 shown in FIG. 8 of the drawing instead of striking the tab 146 at the tab edge 156 when a prior art type of separator tab was used.

The bottle separator tabs 144 and 146 are hinged on a transverse fold line approximately 10 degrees off of the perpendicular to a side wall of the carrier. The perpendicular to the side wall of the carrier is shown in FIG. 8 as the line 158 and the 10° angle would be the angle shown by the numeral 150 in FIG. 8 of the drawing.

By referring to FIGS. 1 and 5 of the drawing there can be seen the beforementioned transverse fold line 160 of the respective bottle separator tabs 36 shown in the FIGS. 1 and 5. When formed thusly and referring to FIG. 8 of the drawing it can be seen how a pair of adjacent hinged tabs 144 and 146 are angled relative to each other to form a generally V-shaped configuraion which then allows the bottle 152 to be inserted into the carrier striking the tabs 146 at the central portion 154 to thereby eliminate disfigurement of the label 136 since the tab edge 156 does not come in contact with the edge 142 of the label.

From the foregoing, it can be seen that there has been provided by the subject invention a one-piece returnable wrap-around beverage carrier and production blank for forming the carrier which accomplishes all of the objects and advantages of the invention. Nevertheless it is apparent after reviewing the drawings and a study of the specification that changes may be made in the production blank and the carrier within the spirit and scope of the invention and the invention is not to be limited to the preferred embodiment shown which has been given by way of illustration only.

Having described my invention, I claim:

1. An improved bottom panel for preventing disfigurement of bottle labels of bottles inserted in a beverage style basket carrier having a pair of side walls and being of the type having a plurality of bottle separator tabs cut and hinged from the bottom panel, wherein the improvement comprises a plurality of the tabs each being hinged from the bottom panel on a separate transverse fold line, each transverse fold line being straight, each transverse fold line being oriented at an angle of approximately 10° off the perpendicular to the side walls of the carrier wih the fold lines of adjacent tabs and the adjacent tabs being angled relative to each other and converging toward each other as the fold lines and the tabs approach the adjacent sidewall to form a generally V-shaped configuration and the angle of the tab fold lines orienting the tabs to permit bottles to be inserted into the carrier with the bottle striking a flat plane of the tab instead of at a tab edge thereby preventing disfigurement of the bottle label.

2. A one-piece returnable, wrap-around beverage carrier production blank, comprising:

(a) a first partial end panel having hingedly attached thereto, a pair of longitudinal partition panels, each longitudinal partition panel having formed thereon a diagonal cut score line and further having formed thereon at least one handle opening;

(b) a bottom panel hingedly attached to the first partial end panel and having side panels hingedly attached thereto, said bottom panel having formed therein separator means and also having formed therein a plurality of glue tabs adapted to be adhesively secured to said pair of longitudinal partition panels, said separator means comprising a plurality of separator tabs each cut from the bottom panel and hinged from the bottom panel on separate transverse fold lines, each transverse fold line being straight, each transverse fold line being oriented at an angle of approximately 10° off a perpendicular to a longitudinal center line of the blank with the fold lines of adjacent tabs and the adjacent tabs being angled relative to each other and converging toward each other as the fold lines and the tabs approach the adjacent lower sidewall panel to form a generally V-shaped configuration;

(c) a whole end panel hingedly attached to the bottom panel and having formed thereon a plurality of glue flaps;

(d) a top panel hingedly attached to the whole end panel and having formed therein a plurality of bottle openings, the top panel also having formed therein means for removing a portion of the top panel, the top panel also having formed therein at least one handle opening and further having hingedly attached thereto an upper side panel on each side thereof; and (e) a second partial end panel hingedly attached to the top panel and having formed thereon a plurality of glue flaps.

3. A one-piece returnable, wrap-around beverage carrier production blank, comprising;

(a) a first partial inner end panel having hingedly attached thereto a pair of longitudinal partition panels, each longitudinal partition panel having formed thereon a diagonal cut score line and further having formed therein at least one handle opening;

(b) a bottom panel hingedly attached to the first partial inner end panel and having lower side panels hingedly attached thereto, said bottom panel having formed therein separator means and also having formed therein a plurality of glue tabs adapted to be adhesively secured to said pair of longitudinal partition panels, said separator means comprising a plurality of separator tabs each cut from the bottom panel and hinged from the bottom panel on separate transverse fold lines, each transverse fold line being straight, each transverse fold being oriented at an angle of approximately 10° off a perpendicular to a longitudinal center line of the blank with the fold lines of adjacent tabs and the adjacent tabs being angled relative to each other and converging toward each other as the fold lines and the tabs approach the adjacent lower sidewall panel to form a generally V-shaped configuration;

(c) a first whole end panel hingedly attached to the bottom panel and having formed thereon a plurality of glue flaps;

(d) a top panel hingedly attached to the whole end panel and having formed therein a plurality of bottle openings, the top panel also having formed therein means for removing a portion of the top panel, the top panel also having formed therein at least one handle opening and having hingedly attached thereto an upper side panel on each side thereof; and (e) a second end panel hingedly attached to the top panel and having formed thereon a plurality of glue flaps.

* * * * *